US007386098B2

(12) United States Patent
Kanack et al.

(10) Patent No.: US 7,386,098 B2
(45) Date of Patent: Jun. 10, 2008

(54) FINE GEOMETRY X-RAY COLLIMATOR AND CONSTRUCTION METHOD

(75) Inventors: Kris J. Kanack, Loveland, CO (US); Ronald K. Kerschner, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/580,150

(22) Filed: Oct. 12, 2006

(65) Prior Publication Data

US 2008/0095320 A1 Apr. 24, 2008

(51) Int. Cl.
*G21K 1/02* (2006.01)

(52) U.S. Cl. ..... 378/149

(58) Field of Classification Search ..... 378/19, 378/145, 149, 154, 156, 158, 147; 250/505.1; 430/4

See application file for complete search history.

(56) References Cited

U.S. PATENT DOCUMENTS 5,231,655 A * 7/1993 Wei et al. ..... 378/147

* cited by examiner

*Primary Examiner*—Courtney Thomas

(57) ABSTRACT

An X-ray collimator formed of stacked laminated layers with apertures therein aligned to form complex 3-dimensional collimator structures, and method of fabrication thereof, is presented.

14 Claims, 5 Drawing Sheets

FINE GEOMETRY X-RAY COLLIMATOR AND CONSTRUCTION METHOD

BACKGROUND OF THE INVENTION

X-ray inspection systems are often used to inspect objects that may be difficult to inspect using optical or other inspection techniques. For example, x-ray inspection systems are particularly useful in the inspection of objects that are embedded within, or are otherwise visually blocked by, other objects. X-ray inspection involves the capture of projected images of an object under inspection by one or more x-ray sensors. In this regard, one or more x-ray sources generate x-rays that may illuminate one or more sensors as attenuated by an intervening object under inspection. During image acquisition, the quality of the images captured by the one or more sensors may be limited due to the presence of x-ray scatter, which can result in loss of dynamic range in a captured image, thus reducing the system's inspection capability.

To reduce interference from x-ray scatter, a collimator may be placed between an x-ray source and the object space. As used herein, the term "collimator" refers to a device that produces directed beams from one or more x-ray sources. For example, a collimator may collimate x-rays from one or more x-ray sources into one or more fan beams. As used herein, the term "fan beam" refers to an x-ray beam having a constant ratio of major to minor dimension at any transverse cross section. To reduce x-ray scatter in an X-ray inspection system, a collimator may be used to collimate the x-rays generated by the x-ray source(s) into a number of fan beams, each directed at a respective sensor along a respective controlled solid angle. For example, a collimator may be configured to produce one or more fan beams having respective ratios of major to minor dimensions that substantially match respective ratios of major to minor dimensions of corresponding sensor areas—thus, the x-rays substantially illuminate only the sensing area of the sensor(s) located in the imaging plane.

To obtain the advantages of X-ray collimation, very precise tapered windows must be machined into material that is an effective attenuator of X-rays. Tungsten (W) is generally the material of choice for an application where precision, strength and X-ray attenuation are required, although any x-ray attenuating material may be used. However, the manufacture of Tungsten collimators is very expensive due to the miniscule complex shapes that must be created. Although Tungsten is quite pliant in its purest form, it typically contains small concentrations of carbon and oxygen, which gives tungsten metal its considerable hardness and brittleness. Given these properties, collimators made from Tungsten or other hard materials are typically created using Electrical Discharge Machining (EDM) techniques.

In EDM metal is removed by producing a rapid series of repetitive electrical discharges between an electrode and a metal workpiece. The electrical discharges actually remove small amounts of material and allow the electrode to be moved through the metal. The path of the electrode is typically controlled by a computer, which allows extremely intricate contours or delicate cavities that would be difficult to produce with a grinder or other cutting tools.

Lead (Pb) and other softer X-ray attenuating materials can also be used to create lower cost X-ray collimators, but the window sizes must be increased and additional thickness is required compared to Tungsten collimators. Larger windows make a collimator less effective at attenuating scatter X-rays and the additional thickness required for equivalent attenuation reduces the allowable distance from the X-ray source to the object being imaged.

Accordingly, a need exists for creating complex shaped 3-dimensional internal structures in hard materials such as Tungsten to allow the fabrication of effective X-ray collimators at a cost much lower than traditional methods of construction.

SUMMARY OF THE INVENTION

An embodiment of a method for fabricating an x-ray collimator comprises identifying 3-dimensional structures and positions of the 3-dimensional structures in a collimator design, selecting a number of collimator layers, determining 2-dimensional shapes corresponding to the respective identified 3-dimensional structures for each layer, determining, in each collimator layer, positions of the 2-dimensional shapes corresponding to the respective identified 3-dimensional structures for each layer, forming apertures in at least one laminated layer to produce the selected number of collimator layers, each having apertures according to its respective determined 2-dimensional shapes at the respective determined positions, stacking the collimator layers in a position of alignment to form the identified 3-dimensional structures, and attaching the stacked and aligned collimator layers to form a composite collimator structure with the identified 3-dimensional structures therein.

An embodiment of an x-ray collimator comprises a plurality of collimator layers, each collimator layer corresponding to a respective cross-section of the x-ray collimator and each collimator layer having at least one aperture, the plurality of collimator layers stacked and attached to form a composite collimator structure wherein the apertures of the respective collimator layers are aligned to form 3-dimensional hollow structures that direct x-rays generated by an x-ray source into x-ray beams.

An embodiment of an x-ray collimator comprises a plurality of laminated layers having apertures therein, the plurality of laminated layers stacked and attached to form a composite collimator structure wherein the apertures of the respective laminated layers align to form 3-dimensional apertures that direct x-rays generated by an x-ray source into x-ray beams.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Methods and apparatus for forming complex-shaped, 3-D internal structures in hard materials to fabricate x-ray collimators are described. For simplicity and illustrative purposes, the principles of the embodiments are described. Moreover, in the following detailed description, references are made to the accompanying figures, which illustrate specific embodiments. Electrical, mechanical, logical, and structural changes may be made to the embodiments without departing from the spirit and scope of the embodiments.

Embodiments of the invention include methods which utilize a laminated stack of thin sheets to construct an X-ray collimator. The laminated sheets may comprise Tungsten or other X-ray attenuating materials. The 3-dimensional structures required to collimate x-rays according to the desired collimation function may be formed by creating apertures in laminated sheets and stacking the layers to form the required 3-dimensional structures in the composite collimator structure.

Figure 1:
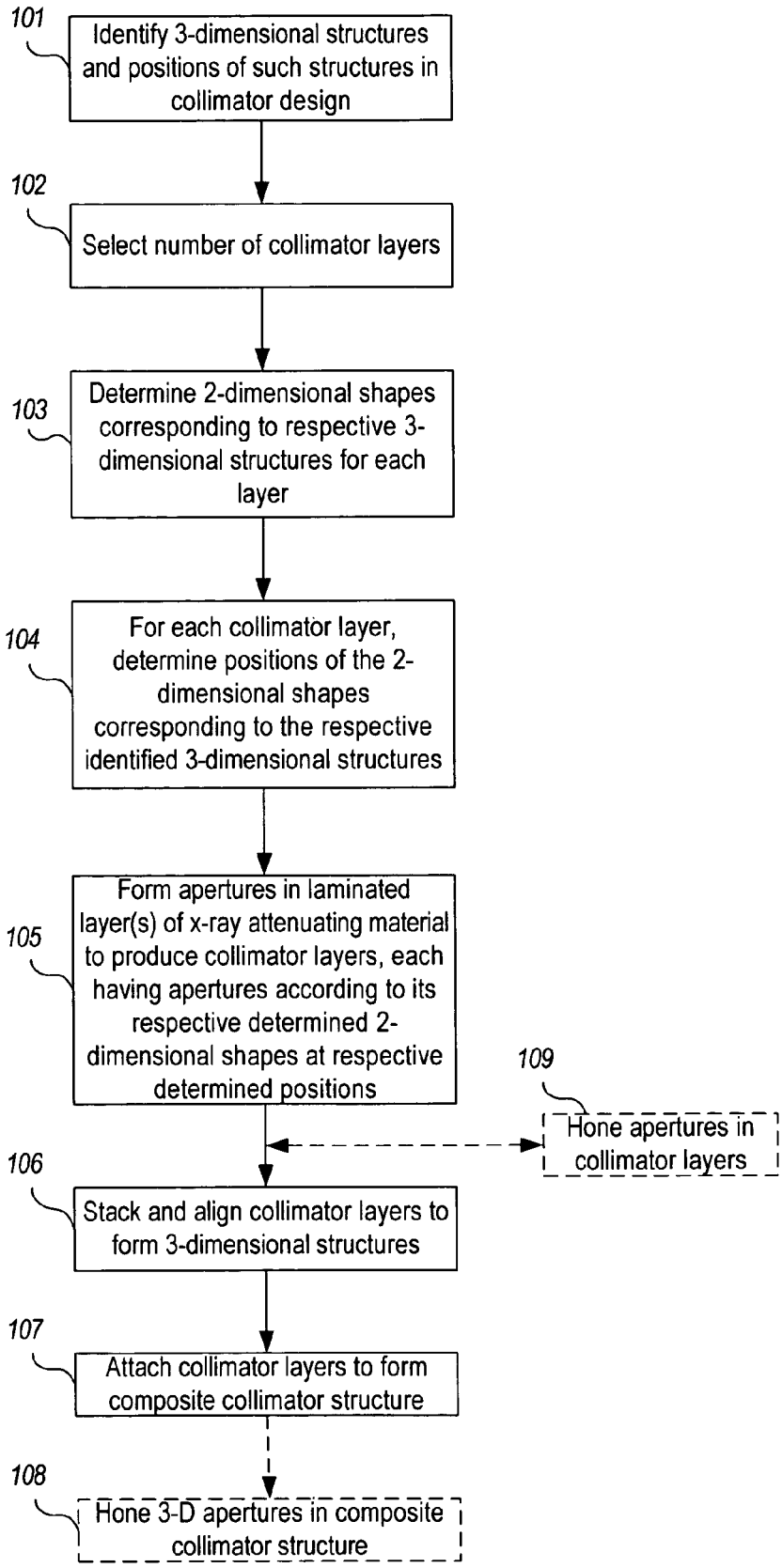
FIG. 1 is a flowchart illustrating an embodiment of a collimator fabrication technique.

FIG. 1 is a flowchart of an embodiment of a method for fabricating an x-ray collimator. The method includes identifying 3-dimensional structures and structure positions in a collimator design (step 101), selecting a number of collimator layers (step 102), determining 2-dimensional shapes corresponding to the respective identified 3-dimensional structures for each layer (step 103), determining, in each collimator layer, positions of the 2-dimensional shapes corresponding to the respective identified 3-dimensional structures for each layer (step 104), forming apertures in at least one laminated layer of x-ray attenuating material to produce the selected number of collimator layers, each having apertures according to its respective determined 2-dimensional shapes at the respective determined positions (step 105), stacking the collimator layers in a position of alignment to form the identified 3-dimensional structures (step 106), and attaching the stacked and aligned collimator layers to form a composite collimator structure with the identified 3-dimensional structures therein (step 107).

The collimator layers may be created from as few as a single laminated layer. In one embodiment, a plurality of collimator layers are created from different sections of a single laminated sheet. The portions of the laminated sheet that outline each collimator layer and the collimator layer's corresponding apertures may be removed through a well-known photo-etching process, or through machine punching, laser-cutting, drilling, or any other material removal process. The individual collimator layers are removed from the laminated layer, and may then be stacked and aligned according to the process described previously.

In the case where the collimator fabrication process creates sharp edges at the meeting points between collimator layers, the edges may be honed or smoothed through extrude honing (i.e., by pushing an abrasive at pressure through the 3-dimensional structures of the composite collimator structures) (step 108). This process may be used to smooth or knock off sharp edges within the 3-dimensional hollow structures in the composite collimator structure.

Alternatively, the apertures of each photo-etched collimator layer may be honed prior to stacking and attaching the collimator layers (step 109).

Embodiments of the invention allow creation of intricate shapes in a thin (for example, 0.001-0.010 inch) laminated sheet made from an X-ray attenuating material such as, but not limited to, Tungsten (W). By varying the sizes and/or shapes of the apertures in each collimator layer, a complex 3-dimensional internal shape can be created by stacking several layers together. The advantages include low raw material cost (for example, the cost of a thin laminated sheet versus a block of material) and low formation cost (for example, forming the layers using process such as photo-etching, punching, or laser-cutting, which are known to be lower cost that EDM techniques. This enables production of a complex X-ray collimator at an overall cost that is much less expensive than traditionally fabricated collimators.

Figure 2A:
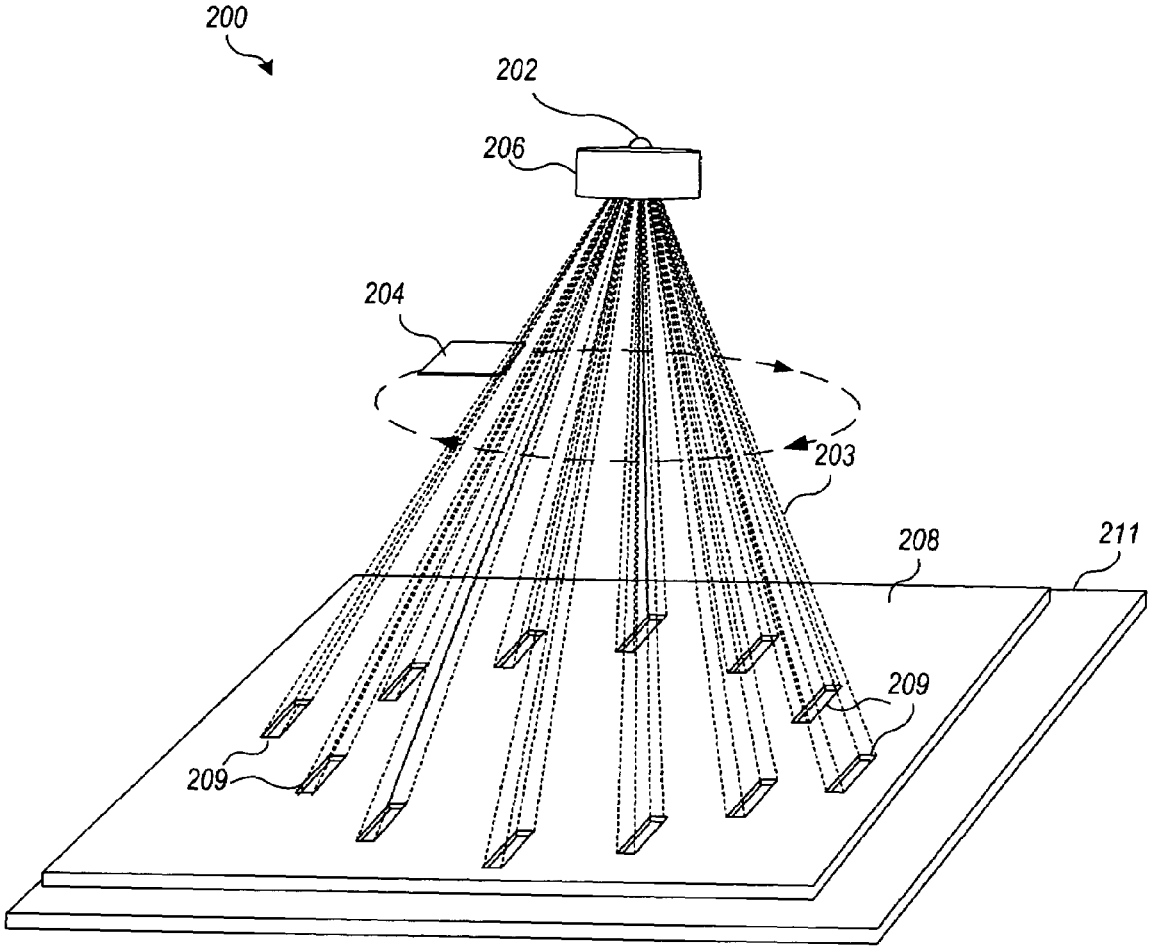
FIG. 2A is a perspective view of an exemplary embodiment of an image acquisition mechanism.
Figure 2B:
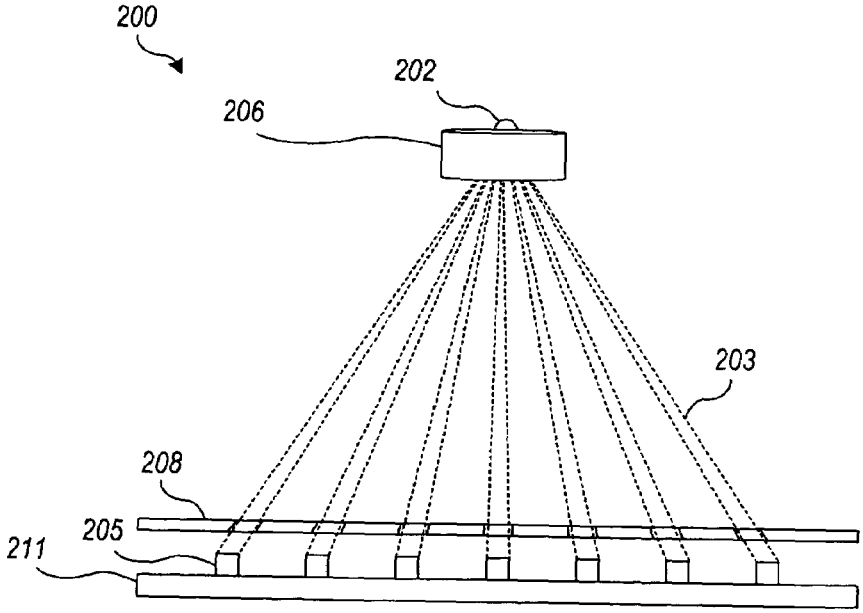
FIG. 2B is a cross-sectional side view of the image acquisition mechanism of FIG. 2A.

FIGS. 2A and 2B show a perspective view and a cross-sectional side view, respectively, of an embodiment of an exemplary image acquisition mechanism 200. In image acquisition mechanism 200, x-ray source 202 is employed to irradiate a planar array of sensors 205 that are sensitive to x-rays. The x-ray source 202 remains stationary relative to the array of sensors 205, projecting x-rays toward all of the sensors 205 simultaneously.

A collimator 206 is employed to restrict x-ray exposure to the locations occupied by the sensors 205 and the intervening areas of the object under inspection in order to limit overall x-ray exposure of the object and to improve the dynamic range of the images captured by the sensors 205. To this end, the collimator 206 generates respective fan beams 203 directed at each of the respective sensors 205.

A field block 208 may be positioned between the x-ray source 202 and the sensors 205 close to the array of sensors. The field block 208 may be an x-ray absorbing plate comprising a respective aperture located over each sensor 205. Each aperture is positioned to expose only the corresponding sensor to the source 202. Furthermore, the field block 208 is positioned a sufficient distance away from the sensor(s) (i.e., the imaging plane) so as to limit the field of view of the respective sensors mainly to that of the corresponding fan beam directed at it. The field block 208 is therefore configured to pass x-rays sourced directly by the x-ray source 202 to respective ones of the sensors 205 and to block detection of reflected or scatter x-rays by the respective sensors 205. In this system, the position of the object under inspection 204 is altered relative to the x-ray source 202, sensors 205, collimator 206, and field block 208, passing between the collimator 206 and field block 208.

The collimator 206 is positioned close to the x-ray source 202 and configured to collimate x-rays generated by the x-ray source into one or more fan beams directed at corresponding ones of the sensors 205.

In operation, an object 204 to be inspected (shown only in FIG. 2A) is moved between collimator 206 and field block 208 to positions that allow each of the sensors 205 to capture projection images of the object after the x-rays have transmitted through the object. Each of the sensors 205 are positioned relative to the x-ray source 202 so that the projection image of the object captured by each sensor 205 is acquired at a distinct angle relative to the x-ray source 202. In the embodiment shown in FIGS. 2A and 2B, a total of twelve sensors 205 are arranged in a circular configuration, resulting in a difference in viewing angle between adjacent sensors 205 of approximately 30 degrees. Each of the sensors 205 is stationary relative to each other and to the x-ray source 202 by way of attachment to a stable base 211.

Figure 3:
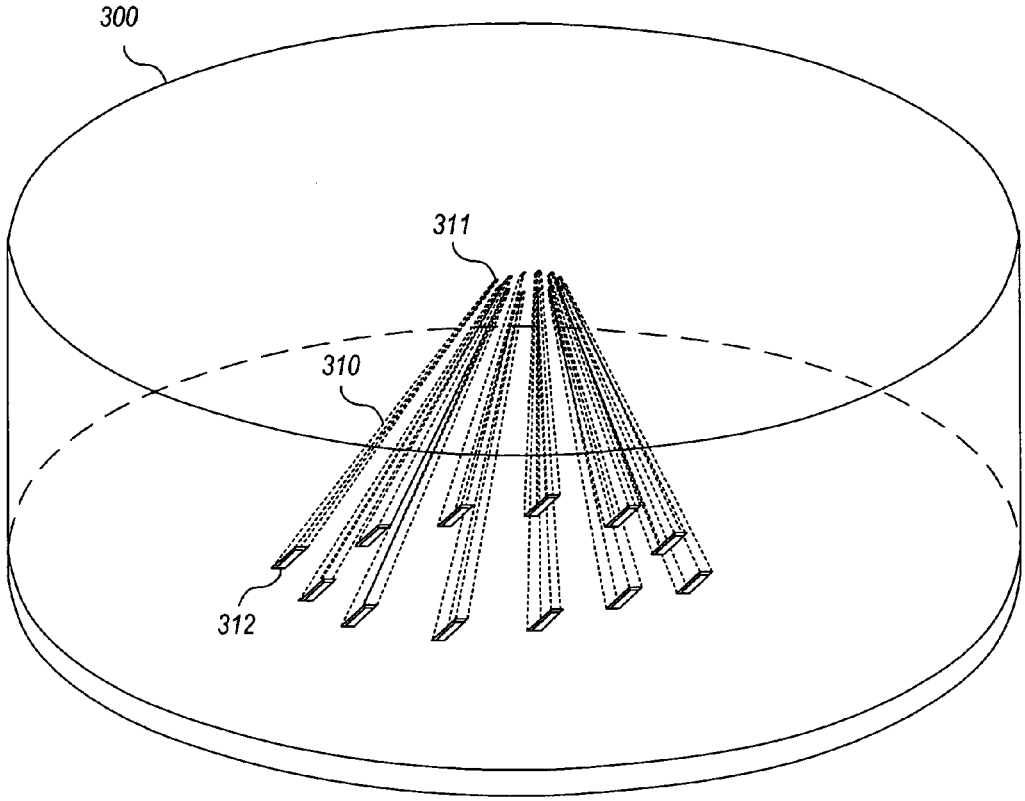
FIG. 3 is a perspective see-through view of a collimator design.

In order to generate the fan beams 203, the collimator 206 must be configured to direct x-rays from the source 202 into beams 203. FIG. 3 is a perspective view of an exemplary collimator design 300 for generating fan beams, such as for use in the example imaging system 200 of FIGS. 2A and 2B. Thus, a collimator implemented in accordance with the collimator design 300 may be used as the collimator 206 which generates the fan beams 203 of the imaging system 200.

As shown in the design 300, the collimator design includes twelve 3-dimensional apertures 310. The 3-dimensional structures of the apertures 310 are narrow pyramidal structures. Each pyramidal structure is hollow, having a respective aperture 310 at the top of the respective pyramid though which x-rays generated by an x-ray point source may enter, and an aperture 312 which forms the hollow base of the pyramidal structure through which the rays exit. The dimensions of the base aperture 312 of its pyramidal 3-dimensional collimator aperture 310 dictates the fan beam coverage at the image plane. The angle of the pyramid with respect to both the x-ray source and the image plane dictates the direction of the fan beam.

Figure 4:
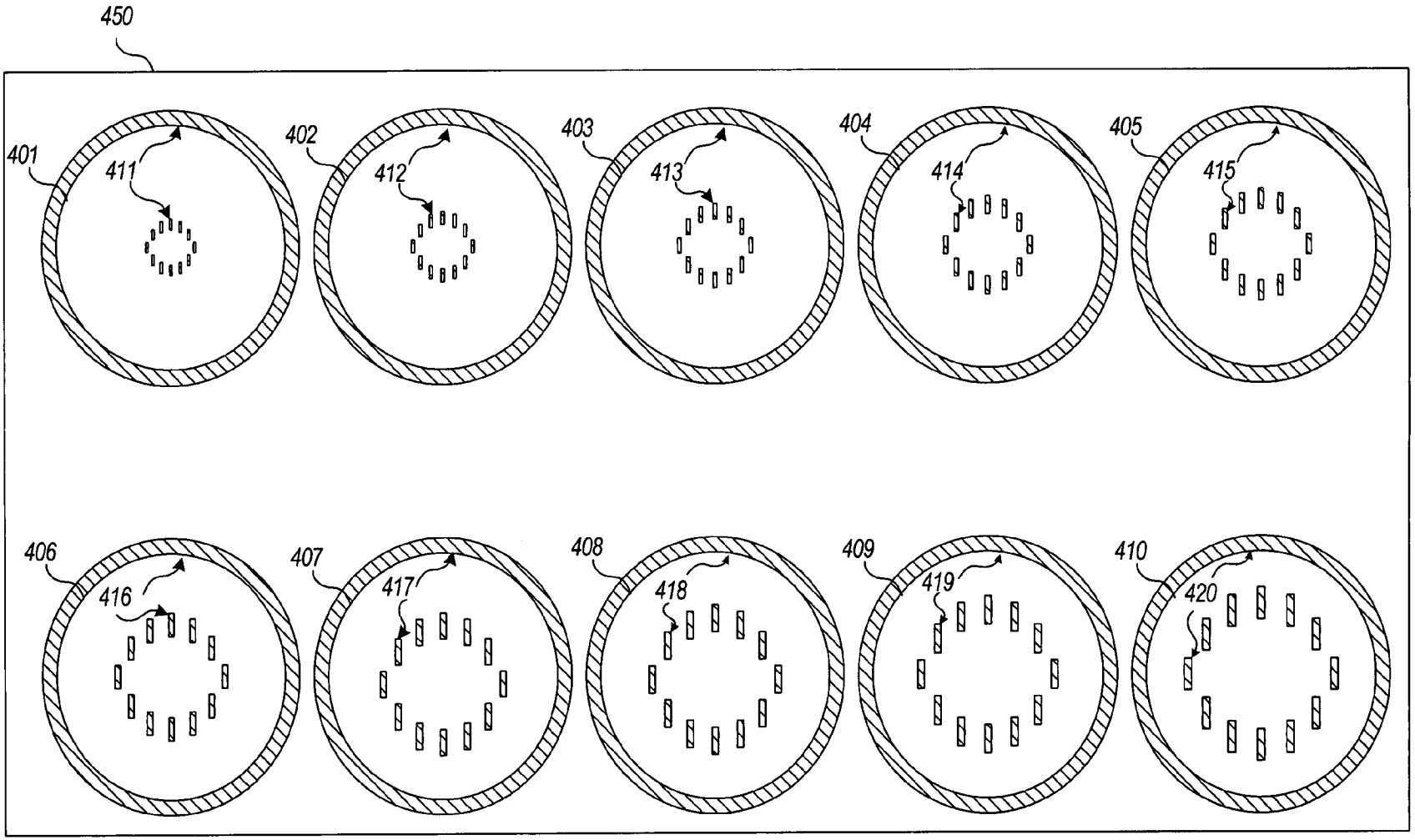
FIG. 4 is a top view of collimator layer etching patterns on a single laminated metal sheet.

In one embodiment, the collimator design 300 may be implemented according to the steps of FIG. 1. In the fabrication of a collimator for the example collimator design 300 of FIG. 3, a number of collimator layers is selected. For illustrative purposes, assume the selected number of collimator layers is ten. Then, the respective 2-dimensional shapes and positions of the respective cross-sections of each 3-dimensional structure in each collimator layer are patterned on one or more laminated metal sheets, and portions of the laminate material are photo-etched, punched, laser-cut, or otherwise removed to create apertures in each collimator layer according to the collimator layer's respective aperture pattern. Thus, for the collimator design of FIG. 3, each layer requires twelve rectangular apertures in, from top to bottom of the collimator design, progressively larger and more spread out positions. FIG. 4 illustrates an example etching pattern 411, 412, 413, 414, 415, 416, 417, 418, 419, and 420 (shown in crosshatch) for ten different collimator layers 401, 402, 403, 404, 405, 406, 407, 408, 409, and 410 for the design 300 of FIG. 3. While each collimator layer may be formed from different respective laminated metal sheets, in one embodiment, a plurality of collimator layers 401, 402, 403, 404, 405, 406, 407, 408, 409, and 410 are simultaneously formed from as few as a single laminated metal sheet. For example, FIG. 4 illustrates the aperture patterns for all ten collimator layers on a single laminated sheet 450.

Figure 6:
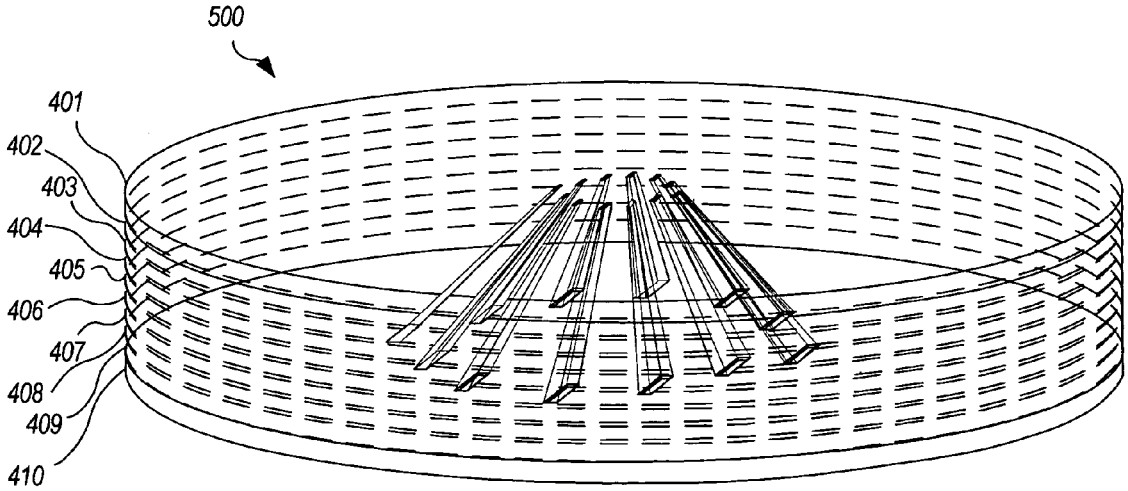
FIG. 6 is a perspective see-through view of a composite collimator structure.
Figure 5:
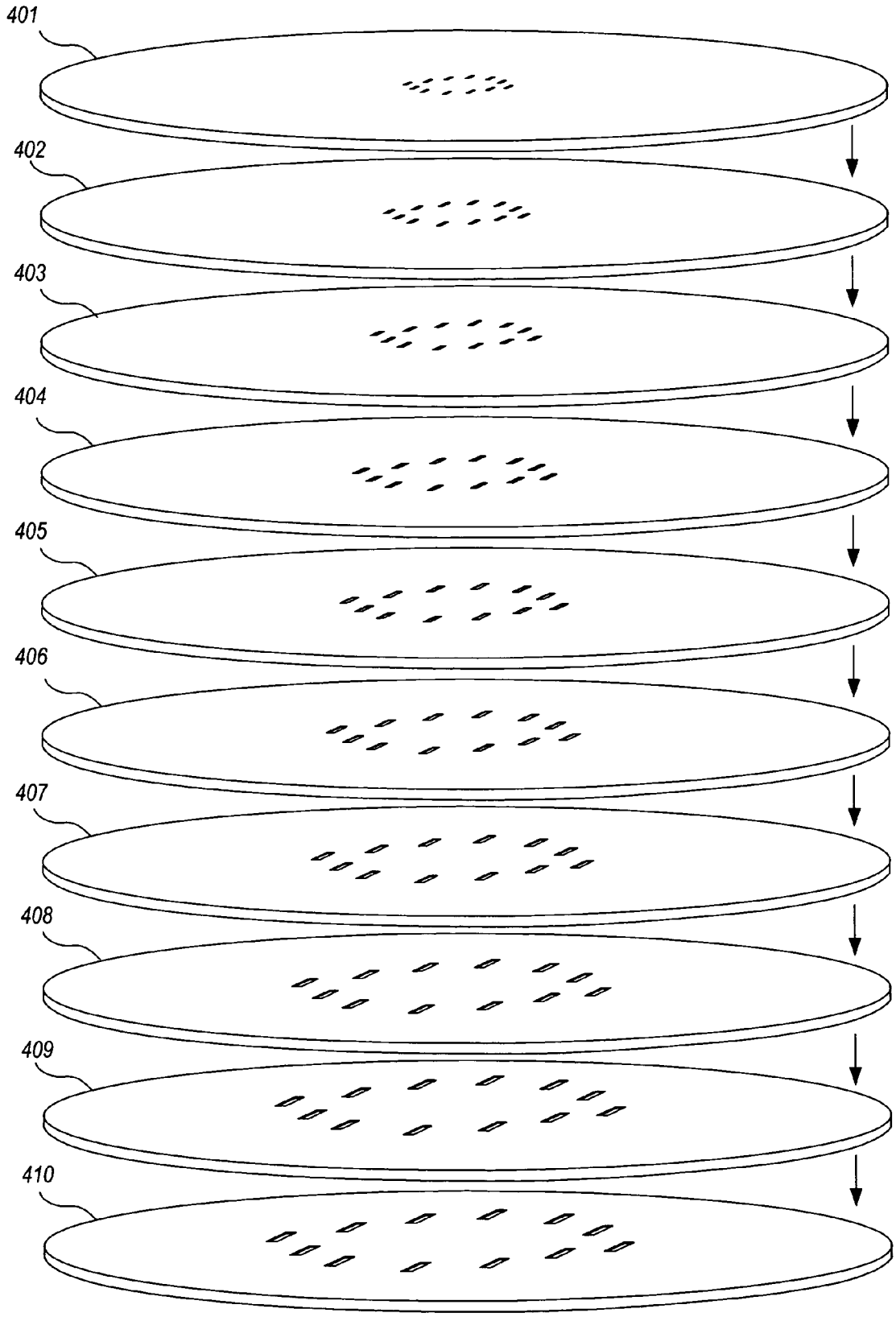
FIG. 5 is an exploded view of a layered collimator.

After photo-etching, punching, laser-cutting, or otherwise, of the laminated sheet(s) 450 to produce the collimator layers 401, 402, 403, 404, 405, 406, 407, 408, 409, and 410, the collimator layers are stacked and attached such that corresponding 2-dimensional apertures of each layer are appropriately aligned to form the 3-dimensional internal structures according to the collimator design. For example, the collimator layers of FIG. 4 may be aligned and stacked as shown in FIG. 5 to produce the composite collimator structure 500 shown in FIG. 6. The collimator layers may be attached using adhesive, rivets, bolts, or other attachment techniques so long as the attachment technique does not interfere with the functionality of the internal 3-dimensional structures in x-ray collimation.

In one embodiment, the edges at the meeting points between collimator layers are honed or smoothed through extrude honing (i.e., by pushing an abrasive at pressure through the 3-dimensional structures of the composite collimator structures) or other appropriate honing technique.

In one embodiment, the apertures of each collimator layer are honed prior to stacking and attaching the collimator layers.

Collimators fabricated according to the collimator fabrication technique described herein may be produced at much less cost than EDM techniques. Furthermore, once the etching patterns for each of the collimator layers are captured in artwork, collimators can be produced in high volume much more quickly than can be done using EDM techniques.

Although embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for fabricating an x-ray collimator, comprising:

identifying 3-dimensional structures and positions of the 3-dimensional structures in a collimator design;

selecting a number of collimator layers;

determining 2-dimensional shapes corresponding to the respective identified 3-dimensional structures for each layer;

determining, in each collimator layer, positions of the 2-dimensional shapes corresponding to the respective identified 3-dimensional structures for each layer;

forming apertures in at least one laminated layer to produce the selected number of collimator layers, each having apertures according to its respective determined 2-dimensional shapes at the respective determined positions;

stacking the collimator layers in a position of alignment to form the identified 3-dimensional structures;

attaching the stacked and aligned collimator layers to form a composite collimator structure with the identified 3-dimensional structures therein; and honing the 3-dimensional structures within the composite collimator structure.

2. The method of claim 1, wherein the forming apertures in at least one laminated layer comprises:

creating the collimator layers from as few as a single laminated layer by simultaneously forming a plurality of collimator layers at different sections of the as few as a single laminated layer, and extracting the plurality of collimator layers from its laminated layer.

3. The method of claim 1, wherein:

the step of forming apertures in at least one laminated layer comprises photo-etching the at least one laminated layer to form the apertures.

4. The method of claim 1, wherein:

the step of forming apertures in at least one laminated layer comprises punching the at least one laminated layer to form the apertures.

5. The method of claim 1, wherein:

the step of forming apertures in at least one laminated layer comprises laser cutting the at least one laminated layer to form the apertures.

6. A method for fabricating an x-ray collimator, comprising:

identifying 3-dimensional structures and positions of the 3-dimensional structures in a collimator design;

selecting a number of collimator layers;

determining 2-dimensional shapes corresponding to the respective identified 3-dimensional structures for each layer;

determining, in each collimator layer, positions of the 2-dimensional shapes corresponding to the respective identified 3-dimensional structures for each layer;

forming apertures in at least one laminated layer to produce the selected number of collimator layers, each having apertures according to its respective determined 2-dimensional shapes at the respective determined positions;

stacking the collimator layers in a position of alignment to form the identified 3-dimensional structures; and attaching the stacked and aligned collimator layers to form a composite collimator structure with the identified 3-dimensional structures therein; and honing the apertures of each collimator layer prior to stacking and attaching the collimator layers.

7. An x-ray collimator comprising:

a plurality of collimator layers, each collimator layer corresponding to a respective cross-section of the x-ray collimator and each collimator layer having at least one aperture, the plurality of collimator layers stacked and attached to form a composite collimator structure wherein the apertures of the respective collimator layers are aligned to form 3-dimensional hollow pyramidal structures that direct x-rays generated by an x-ray source into x-ray beams.

8. The x-ray collimator of claim 7, wherein the plurality of collimator layers are made from thin laminated sheets.

9. The x-ray collimator of claim 7, wherein the plurality of collimator layers comprise Tungsten.

10. The x-ray collimator of claim 7, wherein at least one of the apertures of the collimator layers is honed.

11. The x-ray collimator of claim 7, wherein the 3-dimensional hollow pyramidal structures are fan beam apertures which collimate x-rays from the x-ray source into fan beams.

12. The x-ray collimator of claim 7, wherein the at least one of the apertures of the composite collimator structure has smooth meeting points between the layers so as to form a smooth surface through at least one of the 3-dimensional hollow pyramidal structures.

13. An x-ray collimator, comprising:

a plurality of laminated layers having apertures therein, the plurality of laminated layers stacked and attached to form a composite collimator structure wherein the apertures of the respective laminated layers align to form 3-dimensional pyramidal apertures that direct x-rays generated by an x-ray source into x-ray beams.

14. The x-ray collimator of claim 13, wherein the at least one of the apertures of the composite collimator structure has smooth meeting points between the laminated layers so as to form a smooth surface through at least one of the 3-dimensional pyramidal apertures.

* * * * *